United States Patent [19]

Flakk

[11] Patent Number: 4,475,324

[45] Date of Patent: Oct. 9, 1984

[54] VALVES

[75] Inventor: Egil Flakk, Spjelkavik, Norway

[73] Assignee: Kva-Spil Limited, Spjelkavik, Norway

[21] Appl. No.: 367,577

[22] Filed: Apr. 12, 1982

[30] Foreign Application Priority Data

May 8, 1981 [NO] Norway ..... 811559

[51] Int. Cl.³ ..... E06B 7/14

[52] U.S. Cl. ..... 52/209; 251/90; 251/299; 98/98

[58] Field of Search ..... 98/97, 98, 99 R; 251/228, 298, 89, 90, 299; 292/338, 262; 52/209

[56] References Cited

U.S. PATENT DOCUMENTS

| | | | |
|---|---|---|---|
| 1,433,769 | 10/1922 | Williams | 98/97 |
| 1,473,774 | 11/1923 | Leech, Jr. | 251/90 |
| 2,025,665 | 12/1935 | Dickinson | 251/228 |
| 4,163,574 | 8/1979 | Chezem | 292/338 |

FOREIGN PATENT DOCUMENTS

| | | | |
|---|---|---|---|
| 1237280 | 6/1971 | United Kingdom | 98/99 R |

*Primary Examiner*—Martin P. Schwadron
*Assistant Examiner*—Sheri Novack
*Attorney, Agent, or Firm*—Kenyon & Kenyon

[57] ABSTRACT

Valve suitable for use in a relatively narrow elongate opening to an air duct in a window frame which opening faces inwardly towards an accommodation space. The valve has at least two, preferably three, separately made, elongate members made by extrusion. A first valve body-forming member and a second holder-forming member together with a third support-forming member are adapted to be pivoted relative to each other. In the closed position of the valve the members are adapted to support each other in triangular form over a substantial part of the length dimension of the valve. The first and second members are jointed together as a pair and the third member is jointed together as a pair with the first member as well as being adapted to make a snap-forming supporting abutment against the second member.

8 Claims, 4 Drawing Figures

VALVES

This invention relates to valves for use in a relatively narrow and extended opening, for example, in an opening to an air duct in a window frame directed inwardly into an accomodation space.

Generally, there is represented a problem of being able to achieve a uniform and precisely sought after sealing abutment between the valve body and the valve seat over the whole longitudinal dimension of the valve in relatively narrow and extended valve openings. Particular problems arise if the valve body has the opportunity to give way as a consequence of the lack of local support over the longitudinal dimension of the valve, and this applies, in particular, to valves of light weight construction made, for example, of relatively thin-walled metal plate, plastic material or the like.

As regards a valve located in connection with an air duct in a window frame, there is a need for achieving an accurate sealing of the valve opening, for one thing, in order to avoid undesired "draught" due to air leakage through the valve in its closed position and to prevent collections of moisture as a result of condensation which occurs with such air leakage.

With such an air valve which is desired inwardly towards a room inisde the window frame, it is furthermore of importance that the valve occupies the least possible space outside the window frame and preferably extends substantially flush with the inwardly directed main surface of the window frame. It is also of significance that the valve is designed with a simple and slender construction so that it is, as far as possible, aesthetically attractive and thereby the least possible "visible". However, the possibility of inserting the valve in the window frame, without weakening the frame construction itself, is rather limited.

At the same time as there is a need for a simple and slender valve construction which requires little space, there is a need to produce an especially inexpensive construction which is easy to manufacture and easy to mount. In addition, there is a need for a valve which in the open position gives the largest possible passage opening for ventilation purposes.

A construction hitherto the most conventional consists of a plate-shaped valve seat member with a series of valve openings separated by intermediate unperforated plate portions and a plate shaped valve body with a corresponding series of valve openings separated by intermediate unperforated plate portions. On axial displacement of the valve body, the valve openings in the valve body and the valve seat can be brought into alignment with one another in the open position of the valve or overlapped by the unperforated plate portions in the closed position of the valve. By such a solution, the flow of air through the open valve is rather limited and in the closed valve position it is difficult to ensure accurate sealing between the valve body and the valve seat member.

Instead of a sealing engagement of metal member against metal member, it has been proposed in such known valves to employ elastically yielding sealing material on the valve seat member or on the valve body. However, this has created problems in the axial displacement of the valve body, that is a larger pushing force is required and greater wear results on the sealing surfaces together with the greater possibility for leakage on the worn down sealing surfaces.

It has also been proposed to employ wedge-shaped abutment surfaces between the valve body and the valve seat member in order to ensure an effective clamping engagement between them in the closed position of the valve and a lower friction between them on displacement to and from the closed valve position. Such a position is, however, more demanding of space and provides a relatively complicated and bulky construction.

There has also been employed a cylindrical, hollow valve body which is rotatably mounted in a cylindrical valve housing about the longitudinal central axis of the valve in order to turn between an angular position with aligned openings in the valve body and the valve seat member and an angular position with overlapped openings in the valve body and the valve seat member. With a valve of this type, there is attained a relatively large air flow through the valve in the open position but there have been problems in obtaining sufficient sealing in the closed position of the valve, at the same time as the valve has become relatively space-demanding and bulky.

With the present invention the aim is to avoid the afore-mentioned disadvantages by producing a robust and operatively reliable, effectively sealing valve construction which provides a large air flow in the open position of the valve. An objective is a valve which is easy to manufacture and mount together with being easy to use, at the same time as the valve takes relatively little space and can be fashioned by simple moulding.

Accordingly, the present invention resides in a valve suitable for use in a relatively narrow, elongate opening to an air duct in a window frame which opening faces inwardly towards an accomodation space, said valve having at least two separately made elongate members in an arrangement selected from (i) a first member forming a valve body, a second member forming a holder together with a third member forming a support connected to one of the first and second members and (ii) the first, second and third members separately, the elongage members being adapted to be pivoted relative to each other and in the closed position of the valve to support each other in triangular form over a substantial part of the length dimension of the valve. The first and second members are jointed together as a pair and said third member is connected to, or jointed together as a pair with, the first member or the second member while being adapted to make a snap-forming supporting abutment against the second member or first member or against an additional member.

It is preferred to make the two or three members of extruded profiles. As a result, it is possible to manufacture the members in an inexpensive manner with the desired high degree of accuracy so that the precisely intended supporting abutment and pivotal engagement is obtained between the members in arbitrary portions of the lengths of the members. In this way, one can ensure, in an easy manner, an accurate sealing engagement between the valve body (or the elastic sealing material of the valve body) and the adjacent valve seat around the valve opening, over the whole extent of the length of the valve. Furthermore, it is possible with such extruded profiles to ensure an easy mounting by displacing the members endways into engagement with each other.

It is possible to make the two or three members of relatively thin-walled material from a suitable relatively rigid light metal, the snap-forming supporting abutment between the (support-forming) third member and the first or second member being ensured by employing a suitable coating of elastically yielding material on the seal-forming surface of the first member. If necessary, the intended snap-forming supporting abutment can be ensured by making the third (support-forming) member of a somewhat elastically yielding material, for example, of a suitable plastic material, a suitable resilient metal or the like.

In a preferred valve construction, the first member, which forms with the one main surface a sealing abutment against the peripheral portion of the opening, is provided along the one, downwardly directed longitudinal edge with an elongate, rounded-off head portion which forms a pivotal engagement with an upwardly directed, correspondingly elongate, bearing-forming cavity in the second member, and the third member along the one, upwardly directed longitudinal edge is provided with an elongate, rounded-off head portion which forms a pivotal engagement with an outwardly and downwardly directed, correspondingly elongate, bearing forming cavity in the back side surface of the first member and along the second, downwardly directed longitudinal edge is provided with an elongate head portion which is adapted to form a supporting abutment against an inwardly and upwardly directed, correspondingly elongate cavity in the second member, at a certain distance from the bearing-forming cavity in the second member.

In the afore-mentioned construction, it is possible to open the valve in an especially easy manner since the first member and the third member jointed together therewith fall, after the supporting abutment between the third and second member is eliminated, by their own weight into place in the fully open position with the air opening open to the maximum. Correspondingly easy closing is achieved by pushing the third member upwards and inwards and the first member jointed together therewith, until the lower head portion of the third member is pivoted into position in the associated supporting abutment on the second member, against a spring force in the third member and/or against the force from the elastically yielding sealing material on the first member when the latter forms an abutment against the adjacent valve seat. Another advantage with the downwardly and outwardly opening valve body is that the valve body-forming first member can form guide surfaces for the air stream which flows inwardly through the valve opening so that the current of fresh air can be led in a definite direction inwards into the room present within, for example, parallel to the ceiling of the room.

An especially simple constructional solution is achieved according to the invention due to the first member having a plate-shaped main portion with a pivot bearing-forming, approximately C-shaped projection approximatley along the center of the back side surface of the main portion, the second member having a substantially U-shaped cross-section, with an approximately C-shaped, pivot bearing-forming profile portion at one leg end of the U-shape and with a relatively shallow U-shaped profile portion in the transition between one leg end and web portion of the U-shape, and the third member, between opposing head portion-supporting end edges, being provided with a sideways directed, for example, T-shaped, fastening portion for reception of a separately dismantleable handle portion or finger grip.

In order that the invention can be more clearly understood, a preferred embodiment thereof will now be described, by way of example, with reference to the accompanying drawings in which.

Figure 1:
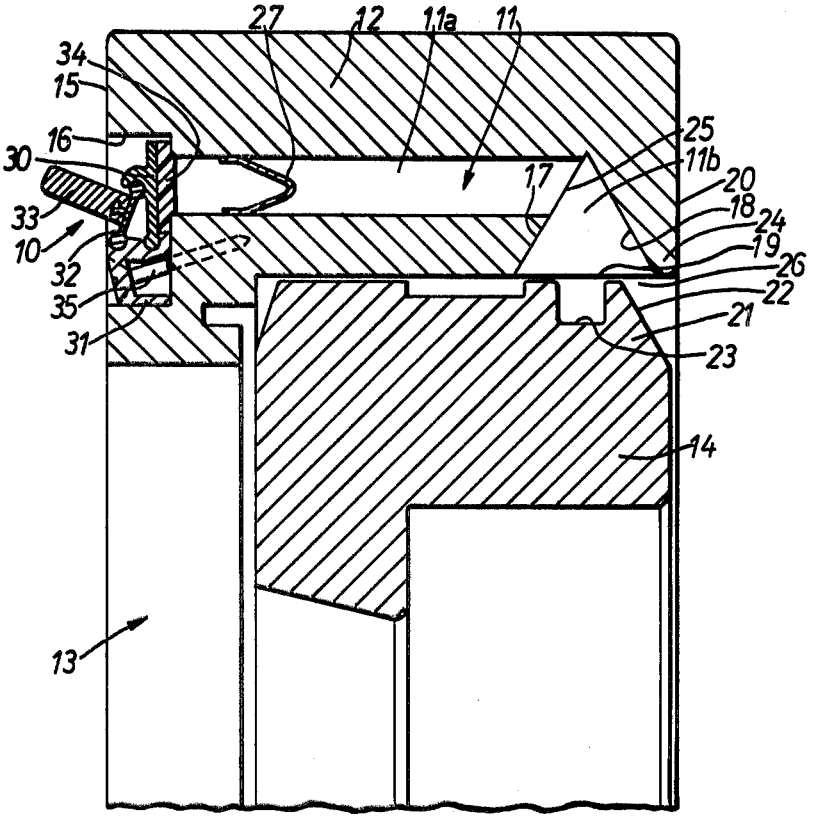
FIG. 1 is a part cross-sectional view of a window frame and associated sash with a valve according to the invention placed in communication with an air duct right through the upper, horizontal frame member of the window frame.
Figure 2:
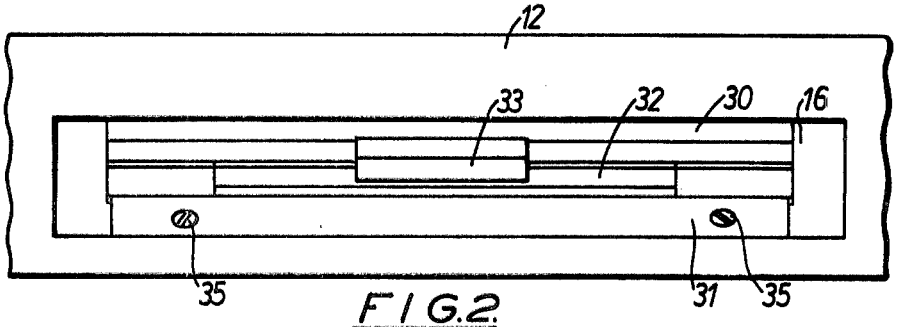
FIG. 2 is a front plan view of the upper frame member with the valve inserted in a cavity in the inwardly facing front side of the frame member.

Referring to FIGS. 1 and 2, a valve 10 is employed in connection with an air duct 11 which is cut out of an upper, horizontal frame member 12 in a window frame 13.

The window frame 13 and the associated window sash 14 are made in a conventional manner of wood. In the inwardly facing front side surface 15 of the frame member 12, there is cut out a relatively elongate groove 16 in which the valve 10 is inserted. From the bottom of the groove 16, there is fashioned, over the major portion of the length of the groove 16, an air duct portion **11*a* which extends in a straight line horizontally inwards into the frame member 12. The air duct portion 11*a* opens outermost outwardly into an outer, downwardly opening air duct portion 11*b* which has a triangular cross-section. The air duct portion 11*b* thus has downwardly diverging sides 17, 18 and an opening 19 arranged just within the outwardly facing front side 20 of the frame member 12, with the opening 19 facing downwards towards an upper, outer edge portion 21 of the sash 14. The upper, outer edge portion 21 of the sash 14 is provided outermost with a downwardly obliquely bevelled guide surface 22 and a draining groove 23 present within. Between the outwardly facing front side 20 of the frame member 12 and the outer, downwardly diverging side 18 of the air duct portion 11*b*, there is fashioned a triangular frame portion 24 which forms a drip nose on the lower portion of the frame member 12 in order to guide heavy rain from the frame member 12 to the guide surface 22 on the sash 14. At the same time, the frame portion 24 covers the intake 25 to the air duct portion 11*a*. By means of inner lying air duct portion 11*b* and the adjacent draining groove 23, there is formed an effective pressure equalising chamber between the air duct portion 11*a* and a gap 26 between the drip nose-forming portion 24 and the guide surface 22. In the air duct portion 11*a*, there is inserted, by simple pushing-in, a V-shaped member 27 of netting or other perforated material in order to prevent the entry of flies and the like through the valve. Alternatively, a perforated plate or netting can be fastened to the inner,downwardly directed side 17 in the air duct portion 11*b***.

The valve according to the invention finds particular application in connection with air ducts in a window frame, such as shown in FIG. 1 and 2, but can also be used in other areas where there is a need for a valve with an effective sealing effect and made of simple and inexpensive parts which are easy to mount and easy to use.

The valve 10 is composed of five separately made members 30, 31, 32, 33, 34. Of these, four members 30–33 are made of light metal by extrusion, while the fifth member 34 is made of sheet-like or band-like, elastically yielding sealing material in the form of a suitably soft rubber which is adhered fast to a first valve body-forming member 30. The first member 30, a second holder-forming member 31 and a third support-forming member 32 form the main parts of the valve. The fifth member 34 can be omitted, if desired, in such circumstances where the first member 30 can form a direct sealing engagement against the valve seat and, in such a case, the valve seat itself can, if desired, be provided with a layer of elastically yielding material. The fourth member 33 is made separately and thereafter, on mounting, is pushed into a more or less permanent connection with the associated third member 32 as a handle or finger grip on this. The reason tht the members 32, 33 are made separately from each other is that the member 33 will project a distance outwards from the frame member 12 during use in the case shown and in order to avoid breakage during storage and transportation, the member 33 is designed separately from the member 32. In other instances, the member 33 (or a similar member) can be made in one piece with the member 32.

In an actual case (not shown), the member 32 can be made in one piece with the member 30 or with the member 31. That is to say instead of joint connecting the member 32 with the member 30 or the member 31, the member 32 can be permanently connected to such a member. By means of the inherent elasticity in the material which the member is made of, there is thereby obtained an intended "snap" effect between the support member 32 and the remaining member which is to be supported or which provides support for the member 32.

The first member 30 and the second member 31 are equally long and span over almost the whole length dimension of the groove 16 in the frame member 12. If desired, however, the member 31 can be somewhat shorter than the member 30 since the member 30, nevertheless, obtains sufficient support in the member 31. The member 32 can, on the other hand, the fashioned significantly shorter than the member 30. If desired, there can be employed two or more such members 32 disposed with suitable intermediate space along the member 30 for local support of the member 30 at suitable locations for this. If desired, the member 33 can be fixed to and span over two or more such separate members 32.

Figure 3:
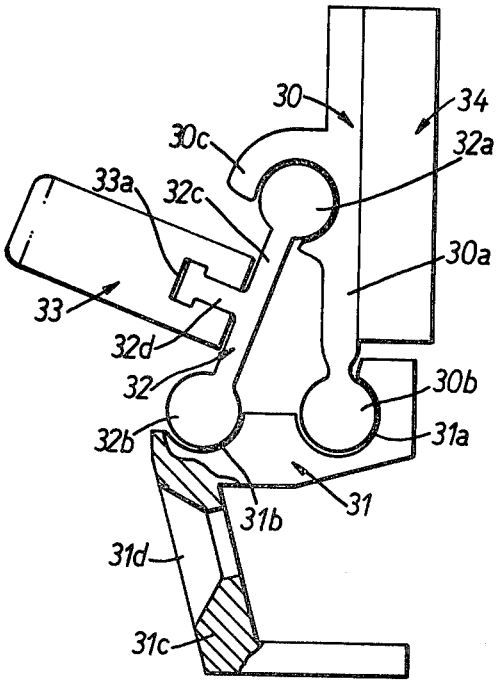
FIG. 3 is a section of the valve illustrated in the closed position.
Figure 4:
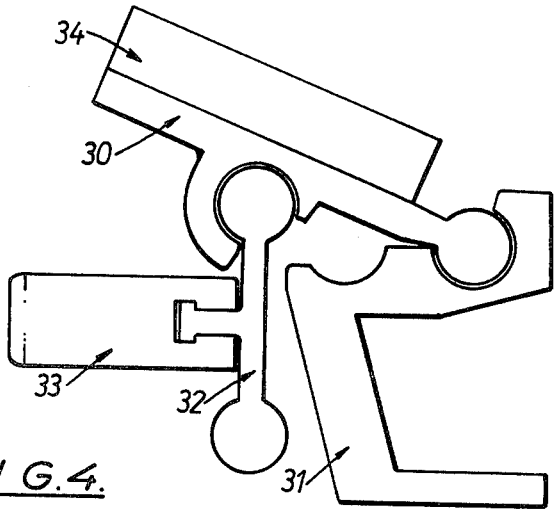
FIG. 4 is as shown in FIG. 3 but with the valve in the open position.

Referring to FIGS. 3 and 4, the first member 30 is designed with a plate-like main portion **30*a* one front side surface of which forms a fastening for the fifth member 34 (the sealing member). Along the lower longitudinal edge of the member 30, there is designed a rounded-off head portion 30*b* which forms an engagement with a pivot bearing-forming cavity 31*a* in the holder-forming second member 31. On the back side surface of the main portion 30*a*, there is formed a rounded-off head portion 32*a* on the upper end edge of the support-forming third member 32. The third member is provided at the lower end edge with a corresponding rounded-off head portion 32*b* which forms a support abutment against a relatively shallow U-shaped cavity 31*b* on the second member 31. Between the head portions 32*a* and 32*b*, the third member 32 has a relatively thin-walled plate portion 32*c* and from the central portion of this plate portion there projects, laterally outwards, a T-shaped projection 32*d* which cooperates with a corresponding T-shaped groove 33*a* along the end edge of the fourth member 33. The second member 31 is designed with a substantially U-shaped cross-section, one U-leg of which forms a supporting abutment against the bottom side of the groove 16, while the opposite U-leg is designed with the two cavities 31*a* and 31*b* arranged at a suitable horizontal distance from each other. The central web 31*c* of the U shape extends obliquely downwards and inwards and is provided with a pair (only one shown in the drawing) of through-going holes 31*d* for the passage of a fastening means, such as a screw 35 for securing the member 31 to the frame member 12 in the groove 16**.

The valve 10 is arranged with the holder-forming member 31 fixed to the side surface and bottom surface of the groove 16 just below the inner mouth of the air duct 11. In such a case, the in-flowing air from the valve will be led horizontally outwards from the upper guide surface of the valve member 30 with the valve member 30 in the open position and, in this instance, the design is preferred as shown in the drawing. As indicated in FIG. 4, the valve member 30 and support forming member 32 are movable under gravity to a lowered open position relative to the holder member 31 when the air duct (not shown) is opened. In another case, the valve can be employed in the reverse position with the holder-forming member fixed in position over the inwardly facing mouth of the air duct and in such an instance, it is preferred that the support-forming member can be adjusted into two different rest positions, that is to say a first rest position (snap; engagement) with the valve in the closed position and a second rest position (snap engagement) with the valve in the open position.

It is also possible, according to an alternative embodiment, to allow the first member 30 to be pivotably mounted below on the second member 31 (which if desired can be designed more simply than shown in the drawing) while the third member 32 can form a support above against a cavity in the frame itself or against a cavity in a fastening piece fixed to the frame above the first member.

In the illustrated embodiment the member 33 is firmly connected to the member 32 but in order to prevent the member 33 from projecting outside the window frame during transportation and storage, the member 33 can be connected to the member 32 with a pivot bearing in a manner corresponding to that which is employed between the members 30, 31 and 30, 32.

I claim:

1. A valve for an air duct in a window frame, said valve comprising a first member forming a valve body for closing off the air duct and including a rounded head portion at one end and a cavity spaced from said one end;

a second member pivotally connected with said first member to define a holder and including an elongated cavity receiving said head portion of said first member in pivotal relation and a second cavity spaced from said elongated cavity;

a third member pivotally connected with one of said first and second members and releasably mounted in the other of said first and second members, said third member including a first rounded head portion pivotally received in said cavity of said first member and a second rounded head portion releasably received in said cavity of said second member; and a sheet-like elastically yielding member mounted on a flat face of said first member.

2. A valve as set forth in claim 1 which further comprises a member secured to said third member in perpendicular relation to define a handle for pivoting of said third member relative to said one member.

3. A valve as set forth in claim 1 wherein said second member has a substantially U-shaped cross-section including a central web having holes for passage of a fastening means therethrough.

4. A valve for an air duct in a window frame, said valve comprising a first member forming a valve body for closing off the air duct, said member including a rounded head portion at one end and a cavity spaced from said one end;

a second member pivotally connected with said first member to define a holder, said second member including an elongated cavity receiving said head portion of said first in pivotal relation and a second cavity spaced from said elongated cavity; and a third member pivotally connected withh one of said first and second members and releaseably mounted in the other of said first and second members, said third member including a first rounded head portion pivotally received in said cavity of said first member and a second rounded head portion releaseably received in said cavity of said second member.

5. A valve as set forth in claim 4 wherein said second member has a substantially U-shaped cross-section including a central web having holes for passage of a fastening means therethrough.

6. In combination with a window frame for a sash having a frame member and an air duct passing through said frame member;

a valve for selectively closing one end of said air duct, said valve comprising a holder member secured to said window frame and having a pair of cavities therein; a valve body forming member pivotally mounted in one cavity of said holder for positioning across said air duct and having a cavity spaced from said holder; and a third member pivotally mounted in a cavity of one of said holder and said valve body forming member and releaseably mounted in a cavity of the other of said holder and said valve body forming member; and said valve body forming member and said third member being movable under gravity to a lowered open position relative to said holder to open said air duct.

7. The combination as set forth in claim 6 wherein said valve further comprises an elastically yielding member mounted on a face of said valve body member.

8. The combination as set forth in claim 6 wherein said frame member includes a groove in a side surface of said frame member and said valve is mounted within said groove.

* * * * *

UNITED STATES PATENT AND TRADEMARK OFFICE

CERTIFICATE OF CORRECTION

PATENT NO. : 4,475,324

DATED : October 9, 1984

INVENTOR(S) : Egil Flakk

It is certified that error appears in the above-identified patent and that said Letters Patent is hereby corrected as shown below:

| Column | Line | Change From | To |
|---|---|---|---|
| 2 | 45 | "said" | --the-- |
| 5 | 15 | "tht" | --that-- |
| 5 | 55, 56 | after "formed a" insert --C-shaped projection 30c which forms a pivot bearing for a -- | |

Signed and Sealed this

Sixteenth Day of April 1985

[SEAL]

*Attest:*

DONALD J. QUIGG

*Attesting Officer*

*Acting Commissioner of Patents and Trademarks*